US005901649A

United States Patent [19]

Hathaway et al.

[11] Patent Number: 5,901,649

[45] Date of Patent: May 11, 1999

[54] ROLL ON-ROLL OFF PIGGYBACK BIMODAL TERMINAL SYSTEM

[75] Inventors: Richard C. Hathaway, Greenville; Mearl K. Bridges, New Madison; John M. Barr, Euphemia; Donald R. Klein, Greenville, all of Ohio; Edmond S. Miksch, Pittsburgh, Pa.

[73] Assignee: KACI Terminals System, Ltd., Greenville, Ohio

[21] Appl. No.: 08/869,453

[22] Filed: Jun. 5, 1997

[51] Int. Cl.[6] ..... B61B 1/00

[52] U.S. Cl. ..... 104/29; 105/3

[58] Field of Search ..... 104/27, 28, 29, 104/30; 414/333; 105/3, 4.1, 4.2, 4.3

[56] References Cited

U.S. PATENT DOCUMENTS

| | | | |
|---|---|---|---|
| 428,385 | 5/1890 | Emery | 104/28 |
| 1,789,436 | 1/1931 | Hegel | 104/29 |
| 2,896,548 | 7/1959 | Obes | 104/29 |
| 2,920,580 | 1/1960 | Williams . | |
| 4,129,079 | 12/1978 | Shannon . | |
| 4,190,393 | 2/1980 | Landow . | |
| 4,421,360 | 12/1983 | Newton . | |
| 4,441,764 | 4/1984 | Newton . | |
| 4,453,777 | 6/1984 | Newton . | |
| 4,483,652 | 11/1984 | Barry . | |
| 4,652,057 | 3/1987 | Engle et al. . | |
| 4,702,291 | 10/1987 | Engle . | |
| 4,718,351 | 1/1988 | Engle . | |
| 4,776,648 | 10/1988 | Newton et al. . | |
| 4,883,000 | 11/1989 | Engle . | |
| 4,947,761 | 8/1990 | Engle . | |
| 4,973,206 | 11/1990 | Engle . | |
| 5,154,123 | 10/1992 | Loomer . | |

FOREIGN PATENT DOCUMENTS

| | | | |
|---|---|---|---|
| 9001734 | 11/1990 | European Pat. Off. . | |
| 54-97918 | 8/1979 | Japan | 104/29 |
| 11490 | of 1846 | United Kingdom | 104/27 |
| WO 91/07301 | 5/1991 | WIPO | 104/29 |

*Primary Examiner*—Mark T. Le
*Attorney, Agent, or Firm*—James Ray & Associates

[57] ABSTRACT

The invention is a system for transporting highway vehicles on railway vehicles. It has rail cars positionable relative to one another at an angle of at least about 50 degrees. Each car has a deck for highway vehicles. The system has a railroad terminal with a first track with switch(es) connected to spur(s) so trucks supporting a first set of car ends may be kept on the first track, while a second set of trucks supporting a second set of car ends is placed on the spur(s). The rail cars are thereby placed in a zig-zag configuration. For each of the rail cars, a truck supporting one end remains on the first track while a truck supporting the other end is placed on a spur. A vector parallel to the direction of travel of a truck along the tracks supporting it has a vector component of at least about 0.25 in a direction parallel to the centerline of a railway vehicle supported on the truck, so forces for moving rail cars into and out of the zig-zag configuration may be communicated by tension or compression along the rail cars. The terminal has a dock or ramp having an elevation about equal to the elevation of the rail cars so that highway vehicles may be driven or pulled onto or off the rail cars. The terminal has a roadway or other driveable path to an external highway system.

26 Claims, 12 Drawing Sheets

ROLL ON-ROLL OFF PIGGYBACK BIMODAL TERMINAL SYSTEM

CROSS-REFERENCE TO RELATED APPLICATIONS

The invention taught in this patent application is closely related to the invention taught in the following patent application: ROLL ON—ROLL OFF BIMODAL TERMINAL SYSTEM, which is now U.S. Pat. No. 5,836,251. The teachings of the referenced application are included in the present application by reference thereto.

FIELD OF THE INVENTION

The present invention relates, in general, to a system for loading highway vehicles onto railroad vehicles, and for unloading highway vehicles from railroad vehicles.

BACKGROUND OF THE INVENTION

In general, the most efficient point-to point transportation of freight combines the best features of the railroad system and the highway system. Highway vehicles are preferred for reaching most individual addresses, because of the ubiquity of the highway system. However, for long distance transportation, where cost per ton-mile is very important, the railroad system is the most efficient.

One method of exploiting the advantages of the two systems is to use highway vehicles to pick up freight at specific addresses, and then to load the highway vehicles onto railroad vehicles for long distance transportation. Subsequently, in the vicinity of the destination, the highway vehicles are off-loaded, and used to carry the freight to the final addresses.

Most commonly, the highway vehicles are tractor trailer combinations. After picking up freight at specific addresses, the tractor-trailer combinations are driven to terminals, where the trailers are uncoupled from the tractors and placed on railroad vehicles. The trailers are then carried on the railroad vehicles to terminals close to the intended destinations for the freight. The trailers are then removed from the railroad vehicles, connected to tractors and are then pulled to their destinations.

One method of loading the trailers onto railroad vehicles is to lift them by machinery such as cranes or forklifts. The required machinery for lifting the loaded trailers is very large and expensive, and the method cannot readily be used for trailers such as tankers without the addition of a large amount of structure to such trailers. This approach considerably increases the ton-miles to be carried.

Another approach to loading and unloading of highway trailers onto railway vehicles is "circus loading". In this procedure, a consist of coupled railroad cars, which may be, for example, flat cars or box cars, are moved into a position in which one end of the consist is adjacent a dock for motor vehicles. Plates are positioned on the railway vehicles so as to provide a continuous roadway between coupled railway vehicles. Tractors are used to back the trailers, one at a time, down the line of railway cars. As each trailer reaches its intended location in the train, it is uncoupled, and the tractor is then driven off. A consist including a locomotive then pulls the consist on which the trailers are carried to a destination terminal. At the destination terminal, the consist carrying the trailers is again positioned adjacent a dock for motor vehicles. Tractors are backed down the line of railroad cars, coupled to the trailers, and used to pull the trailers off the consist of railway vehicles. As during the loading operation, this also must be done one at a time. Each trailer must be secured to the railway vehicle on which it is placed, for example, by stanchions attached to the railway vehicle.

Since the procedures cited above have major disadvantages, including the disadvantages mentioned, various other methods of loading trailers onto and removing trailers from railway vehicles have been contemplated, and some of these have been employed.

One approach is to use a platform structure which is permanently attached to a railroad flatcar by a pivot which has a vertical axis. The platform structure is used for supporting a highway trailer vehicle. The platform structure may be swung about the vertical pivot to a position at an angle to the flat car that so a trailer can be moved from a dock adjacent the flat car onto the platform structure. The platform structure can then be rotated to a position parallel to the railroad vehicle for travel. Examples are U.S. Pat. No. 4,129,079 and PCT publication number WO 91/07301. One disadvantage of this approach is that the weight of the platform structure must be transported with the trailer. Another disadvantage is that the structure elevates the trailer, causing clearance problems and center of gravity problems.

An approach similar to the above employs a rotary loader attached to the dock. It is rotated so a portion of it is extended over the railway vehicle so trailers can be moved on and off of the railway vehicles. This is U.S. Pat. No. 4,483,652.

Another approach is to use a moveable ramp, which can be moved along the edge of a dock adjacent the railway vehicles, and extend bridges to a position oblique to the railway vehicles and the edge of the dock so that trailers can be moved onto and off of the railway vehicles. U.S. Pat. No. 4,190,393 employs this approach.

U.S. Pat. No. 2,920,580 provides an approach in which a consist of railway vehicles has, for each pair of adjacent railway vehicles, a common bogie supporting the adjacent ends of the two railway vehicles. The bogie is supported on two trucks, each truck having two axles. The consist is moved along a spur track which has a switch which is used to switch every other bogie onto a supplemental spur track, but to leave the remaining bogies (which alternate with the switched bogies) on the first spur. The second spur curves away from the first spur, and then curves back to run parallel to the first spur. The distance between the parallel portions of the two spurs is equal to the distance between end pivots of each of the railway vehicles. A loading dock is provided alongside each of the two spurs. The railway vehicles are moved onto the spurs until adjacent railway vehicles are parallel to each other in a jack-knifed relationship. In that configuration, they are positioned perpendicular to the loading docks, the bogies and both of the spur tracks. When the railway vehicles are in that position, trailers can be pulled from the docks onto the railway vehicles. Energy storage means are required so that the railway vehicles can be moved out of the jack-knifed configuration. This approach probably has severe problems placing the railway cars in the jack-knifed position, and bringing them out of the jack-knifed position, since tractive forces applied by a locomotive would be perpendicular to the bogies and would tend to topple them off the tracks, rather than move the bogies along the tracks. Also, this arrangement of bogies supported on trucks would waste considerable space between adjacent cars, and would add considerable weight to the rail-borne portions of the system.

SUMMARY OF THE INVENTION

The invention describes a system for transporting highway vehicles on railway vehicles which includes a consist of railway vehicles configured so that adjacent pairs of railway vehicles can be positioned relative to one another at a relative angle of at least about 50 degrees, each of the railway vehicles having a deck for supporting one or more highway vehicles. The system also has a railroad terminal having a terminal track system which has a first track portion connected to a railroad track system outside of the terminal, so that the consist of railway vehicles may be moved by a motive means such as a locomotive from the track system outside of the terminal onto the first track portion. The terminal track system has at least one switch having a common track connection, a first selectable track connection and a second selectable track connection. The first track portion is connected to the common track connection of the switch or switches and to the first selectable track connection of the switch(es). The terminal track system also has one or more track spurs connected to the second selectable track connection(s) of the switch(es) so that as the consist of railway vehicles is moved along the first track portion, a first set of trucks supporting a first set of ends of the vehicles of the consist may be kept on the first track portion, while a second set of trucks supporting a second set of ends of the vehicles of the consist is directed by the switch(es) onto the track spur(s) connected to the second selectable track connection(s) of the switch(es). In this manner, the consist of railway vehicles is placed in a zig-zag configuration. This configuration is such that each railway vehicle has a truck supporting one end of the vehicle on the first track portion, while a truck supporting the other end of the vehicle is supported on a track spur. The track system has dimensional parameters relative to the length of the railroad vehicles such that for each truck, a unit vector parallel to the direction of travel of the truck along the track supporting it has a vector component of at least 0.25 in a direction parallel to a longitudinal axis of at least one railway vehicle having an end supported on the truck, so that forces for moving the railway vehicles into and out of the zig-zag configuration may be communicated along the consist of railway vehicles by either tension or compression communicated longitudinally along the railway vehicles.

The terminal has at least one surface for support of highway vehicles, at least a portion of the surface having an elevation about equal to the elevation of at least one end of at least one of the railway vehicles and adjacent the railway vehicle so that the highway vehicles may be either driven onto or pulled onto the railway vehicle from the surface for support of highway vehicles, and also driven off of or pulled off of the railway vehicle onto the surface for support of highway vehicles. The surface for support of highway vehicles has a roadway or other driveable path to a roadway system outside of the terminal.

In an additional aspect, the invention provides a method of loading highway vehicles onto railway vehicles disposed in a consist of railway vehicles. The method includes moving the consist of railway vehicles along a first track segment having at least one switch connected to at least one spur.

The method includes setting the switches so that as the consist is moved along the first track segment, a first set of trucks supporting a first set of ends of the railway vehicles is retained on the first track portion, while a second set of trucks supporting a second set of ends of the railway vehicles is directed by the switch(es) onto the spurs. Thus the consist of railway vehicles is placed in a zig-zag configuration such that for each railway vehicle, a truck supporting one end of the vehicle is supported on the first track portion, and a truck supporting the other end of the vehicle is supported on the track spur(s). The track system has dimensional parameters relative to the length of the railway vehicles so that for each truck, a unit vector parallel to the direction of travel of the truck has a vector component of at least about 0.25 in a direction parallel to the longitudinal axis of at least one railway vehicle having an end supported on the truck, so that forces for moving the railway vehicles into and out of the zig-zag configuration may be communicated along the consist of railway vehicles by at least one of tension and compression communicated longitudinally along the railway vehicles. The method also includes providing at least one surface for support of highway vehicles having at least a portion at approximately an elevation of a deck of at least one of the railway vehicles. The at least one surface for support of highway vehicles is disposed adjacent at least one end of one or more of the railway vehicles. The method also includes the steps of moving the highway vehicles either onto or off of the railway vehicles, and moving the consist of railway vehicles out of the zig-zag configuration so that the consist may be attached to a train and pulled over conventional railway lines.

OBJECTS OF THE INVENTION

It is, therefore, one of the primary objects of the present invention to provide a system whereby highway vehicles may be loaded onto and unloaded from railway vehicles.

Another object of the present invention is to provide a system whereby highway vehicles may be loaded onto and unloaded from railway vehicles, without adding significant additional weight to the railway vehicles.

An additional object of the present invention is to provide a system whereby highway vehicles may be loaded onto and unloaded from railway vehicles without requiring extensive lifting equipment for placing highway vehicles on the railway vehicles or removing highway vehicles from the railway vehicles.

Still another object of the present invention is to provide a system whereby highway vehicles may be loaded onto and unloaded from railway vehicles without requiring complex and time-consuming operations.

Yet another object of the present invention is to provide a system whereby highway vehicles may be loaded onto and unloaded from railway vehicles which can load and unload any type of highway vehicle without requiring that special hardware be attached to the highway vehicle.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing figures and with the appended claims.

Figure 1:
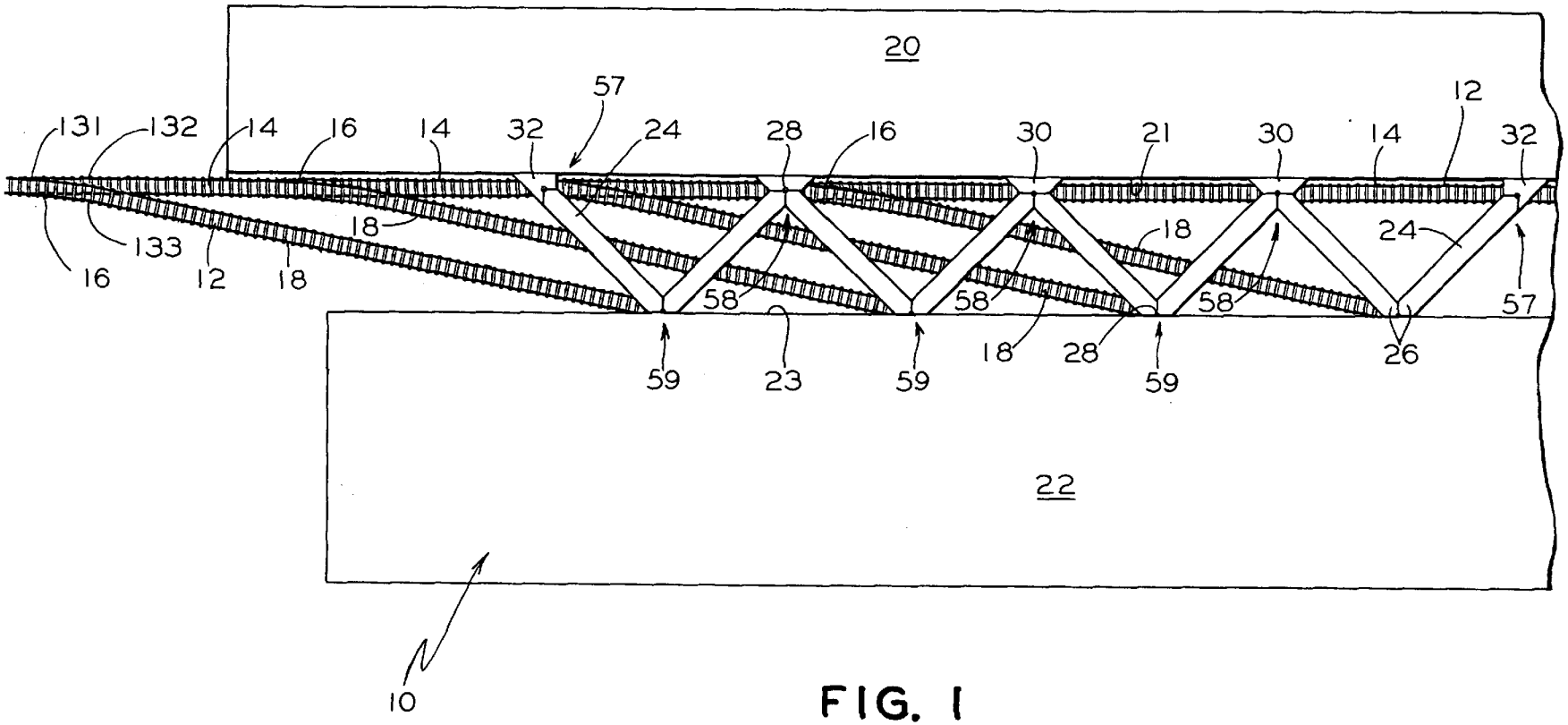
FIG. 1 shows a plan view of a terminal having four spurs and two docks with an eight car consist which is in position for loading and unloading highway vehicles.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures, for the sake of clarity and understanding of the invention.

In the description which follows, and in the subsequent claims, the term "highway vehicle" is intended to include off-road vehicles such as military tanks, bulldozers, graders, etc.

Also, in the description which follows, the term consist generally refers to a group of cars which are usually kept together in a group. Articulated couplers may be used to join adjacent cars in the consist, while the couplers at the ends of the consist are industry standard couplers which may be connected to other railway vehicles, or to other similar consists.

FIG. 1 shows a plan view of one presently most preferred embodiment of the invention. FIG. 1 shows a terminal 10 having four spurs 18 and two docks 20 and 22. A consist of eight railway vehicles 24 is shown in a zig-zag configuration, which is the position for loading highway vehicles from docks 20 and 22 onto railway vehicles 24.

The terminal shown in FIG. 1 has a first railway track portion 14 having a plurality of switches 16 connected to a plurality of spurs 18. Each of switches 16 has a common track connection 131, a first selectable track connection 132 and a second selectable track connection 133. A portion of first track portion 14 lies adjacent and parallel to edge 21 of dock 20. It is preferred that first track portion 14 be spaced relative to dock edge 21 so that railway vehicles generally, including locomotives, may be moved along first track portion 14 without contacting dock edge 21. This is preferred for operational flexibility. Spurs 18 diverge from first railway track portion 14, and go over to dock 22, and preferably go under edge 23 of dock 22.

The consist of eight railway vehicles 24 is moved into the position shown by motive means (not shown) such as a locomotive. As trucks supporting ends 57 of the consist encounter switches 16, they are retained on first track portion 14. Likewise as a first set of alternating pairs 58 of adjacent ends 26 reach switches 16, they are retained on first track portion 14. Conversely, as each one of a second set of alternating pairs 59 of adjacent ends 26 reaches a switch 16, the switch is set to direct the pair onto the spur 18 connected to the switch. After each switch has directed a truck supporting an adjacent pair of car ends 59 onto its spur, it is reset so that subsequent trucks encountering the switch are retained on first track portion 14.

Vehicles of the consist 24 are preferably joined to each other by disposed at end pivots 28 which may be articulated couplers. The pivoted ends of the vehicles 26 are supported on railroad trucks having flanged wheels (not shown in this figure).

FIG. 1 shows dock plates 30 and end dock plates 32 which bridge across from dock edge 21 to the adjacent ends of railway vehicles 24 so that highway vehicles may be driven onto and off of vehicles 24 from dock 20. Such dock plates are not needed for dock 22, because spurs 18 bring ends 26 of railway vehicles 24 at an angle to dock edge 23 of dock 22. It is preferred that dock 22 be undercut and that spurs 18 extend under edge 23 of dock 22 so that a portion of the truck carrying a pair of car ends can go partly under dock 22 so that a pivot 28 joining two cars can be positioned directly under dock edge 23. This places the pairs of adjacent car ends 59 as shown in FIG. 1, so that dock plates are not needed for dock 22.

Dock plates 30 and 32 may be movably positioned by being hinged to edge 21 of dock 20. It is preferred that they be ribbed for strength on their lower surfaces. They should also rest on adjacent car ends 58 or on side frames of the trucks (not shown in this figure), which support the adjacent car ends 58. Dock plates 32 formed as shown in FIG. 1 may be used at the ends of the consist 57 of vehicles 24 so that highway vehicles may be driven from dock 20 onto and off of vehicles 24.

Driveability between each of the railway vehicles and both of the docks is desired so that highway vehicles including tractor trailers may be pulled onto or driven onto railway vehicles 24 from docks 20 or 22, and, at a destination terminal, driven off, with a minimum of backing. Self powered vehicles would not require backing. A tractor trailer in which the tractor is uncoupled prior to travel would only require backing of the tractor into engagement with the trailer at a destination terminal. It would never be necessary to back a jointed vehicle.

Figure 2:
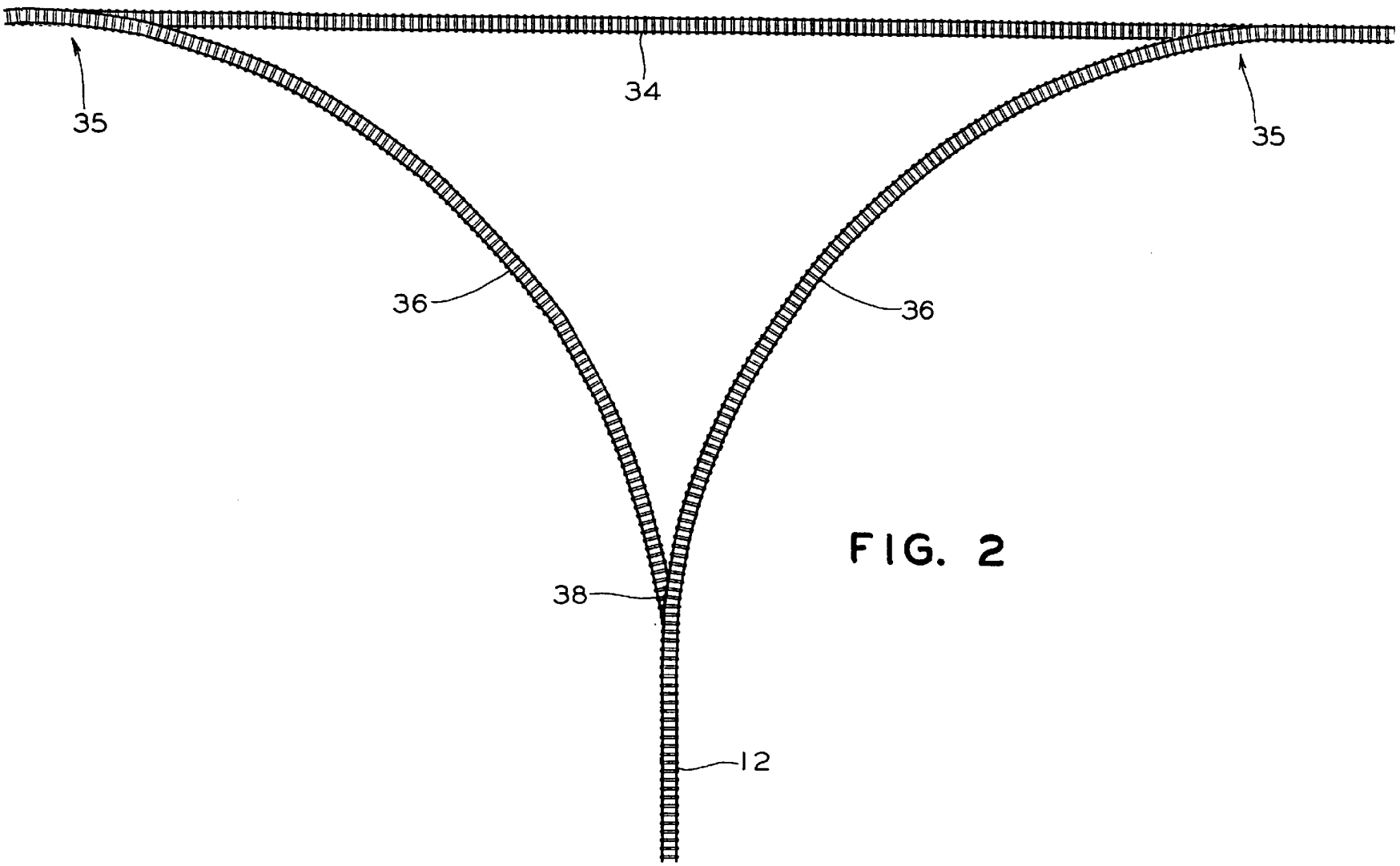
FIG. 2 shows a plan view of a lead in track from a railroad line outside of the terminal.

FIG. 2 shows one possible layout for connecting terminal track system 12 to an external railway system 34. Switches 35 join external track 34 to connection tracks 36 which join at switch 38 and merge with terminal track system 12.

Figure 3:
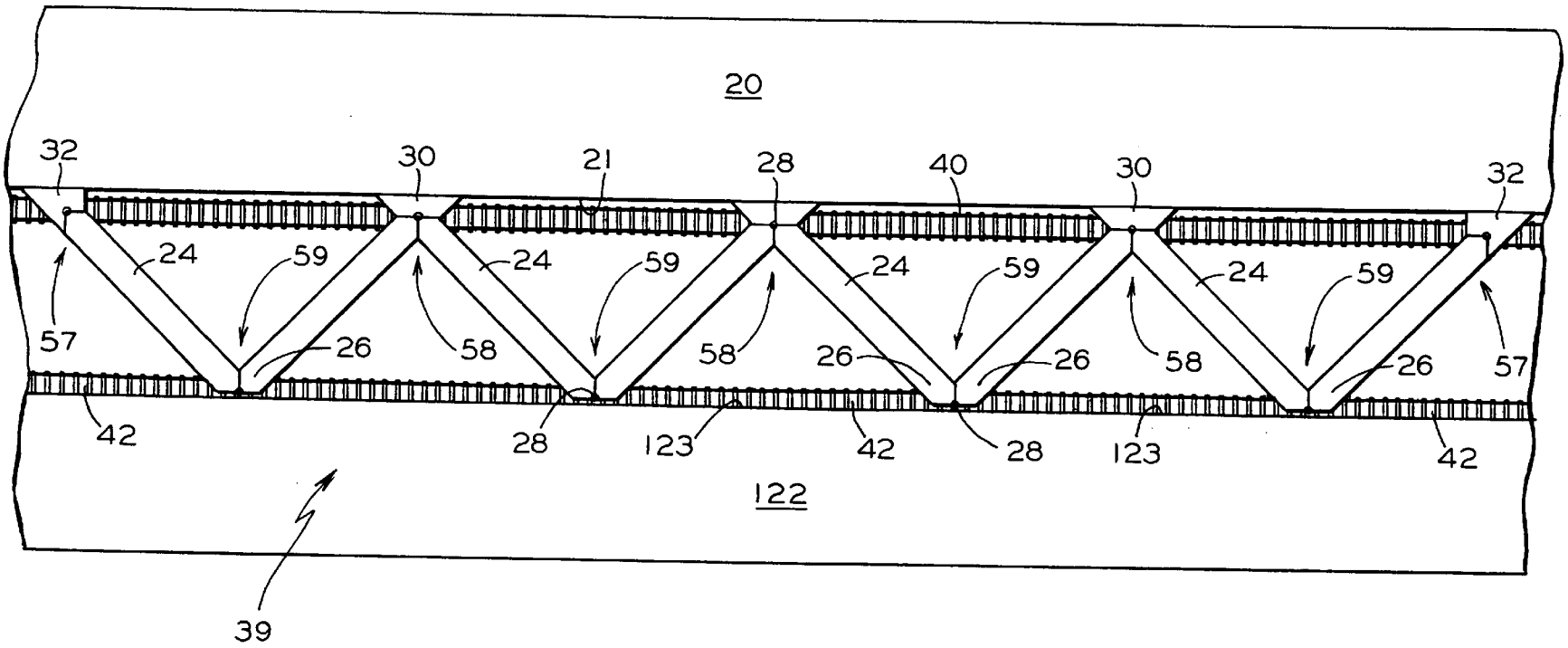
FIG. 3 shows a plan view of a terminal which has a single spur with an eight car consist which is in position for loading and unloading highway vehicles.
Figure 4:
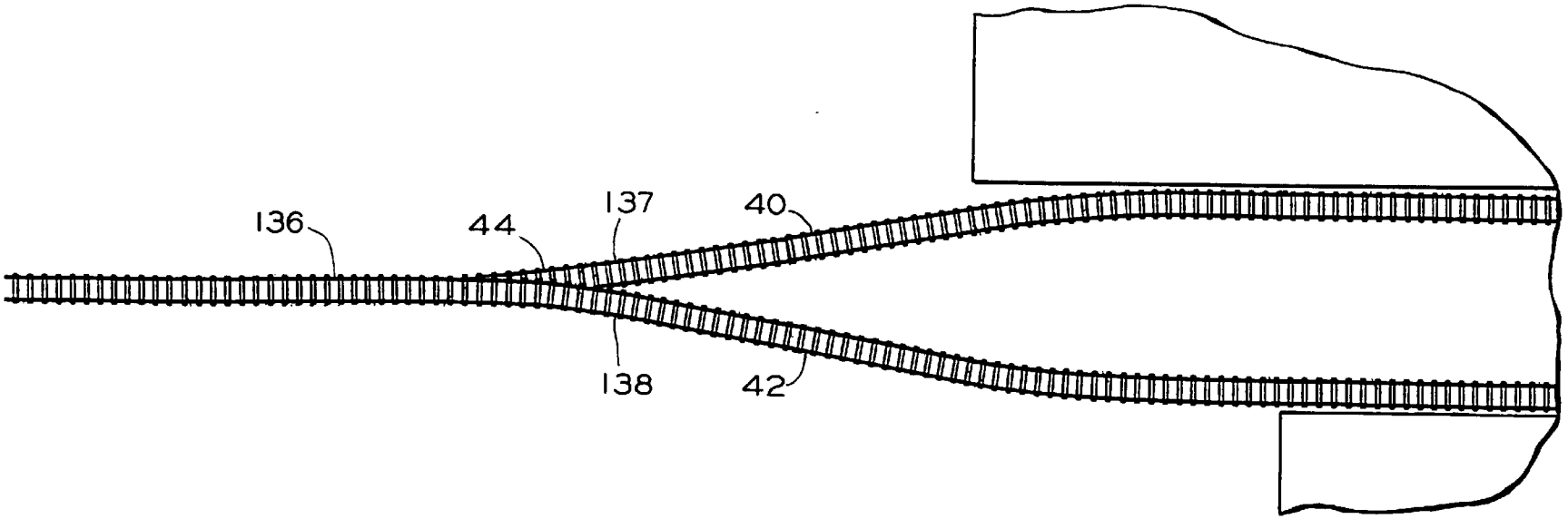
FIG. 4 shows a plan view of a single switch and lead in track for a terminal with a single spur.

FIGS. 3 and 4 show a second presently most preferred embodiment of the invention. Terminal 39 is shown which has a first track portion 40 and a single spur 42. Switch 44 has a common connection 136 attached to the first track portion 40. It has a first selectable track connection also connected to first track portion 40, and a second selectable track connection to which spur 138 is attached. A portion of first track portion 40 lies adjacent and parallel to edge 21 of dock 20. It is preferred that first track portion 40 be spaced relative to dock edge 21 so that railway vehicles generally, including locomotives may be moved along first track portion 40 without contacting dock edge 21. This is preferred for operational flexibility.

A portion of spur 42 lies underneath and parallel to edge 123 of dock 122. Preferably dock edge 123 lies approximately over the centerline of spur 42, so that pivoted connections 28 joining adjacent car ends 59 lie approximately underneath dock edge 123. (Dock edge 123 would be cut back slightly relative to the centerline of spur 123 to provide clearance so that railway vehicles 24 do not contact dock edge 123. This clearance should be small enough that highway vehicles can drive across it.)

Figure 5:
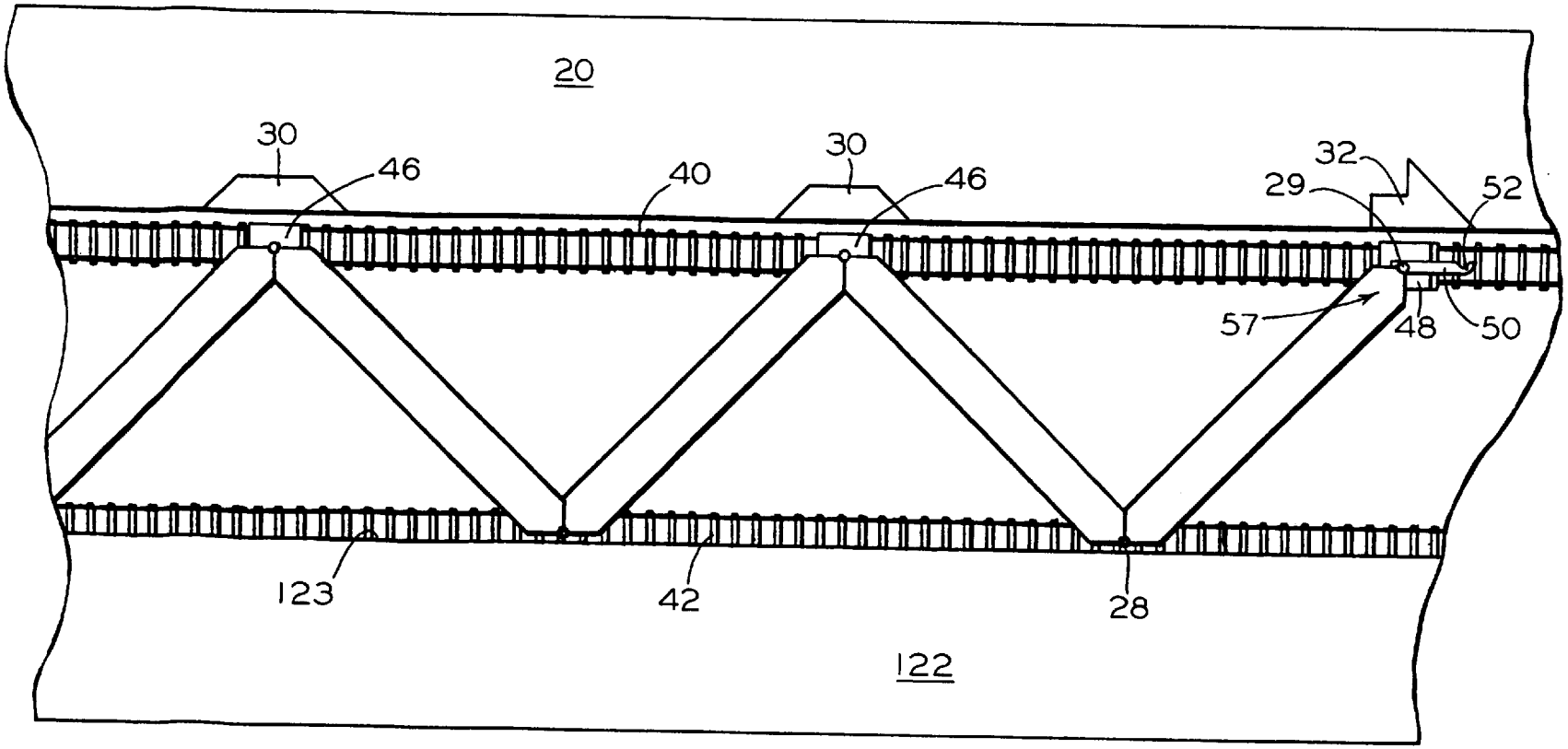
FIG. 5 shows an end truck and coupler of the consist.

FIG. 5 shows one of the dock plates 30 and one of the end dock plates 32 in a retracted position, in which they are laid back on dock 20. In this position they do not interfere with a train moving along first track portion. With dock plate 30 placed in retracted position, truck 46 which supports one of the pairs of coupled ends 58, may be seen. Likewise, with end dock plate 32 retracted, end truck 48 is seen. End truck 48 supports consist end 57 through rotary load bearing connection 29. A longitudinal structural member analogous to the center sill of a conventional freight car is denoted 50. Structural member 50 is attached to industry standard coupler 52 so that the consist of railway vehicles 24 may be coupled to other railway vehicles to make up a train.

It is presently preferred that terminal 39 be built with a slight slope toward the right (of the figure) so that gravity provides assistance in moving railway vehicles 24 along first track portion 40 and spur 42. This is desirable to minimize side forces on bogies 46 and 48, which would increase friction between the wheels of the bogies and the rails. Such a terminal would be planned for use in a single direction, from left to right. If it is necessary for a consist to be moved in from the right and placed in the zig-zag configuration shown, such a slope would not be desirable.

Figure 6:
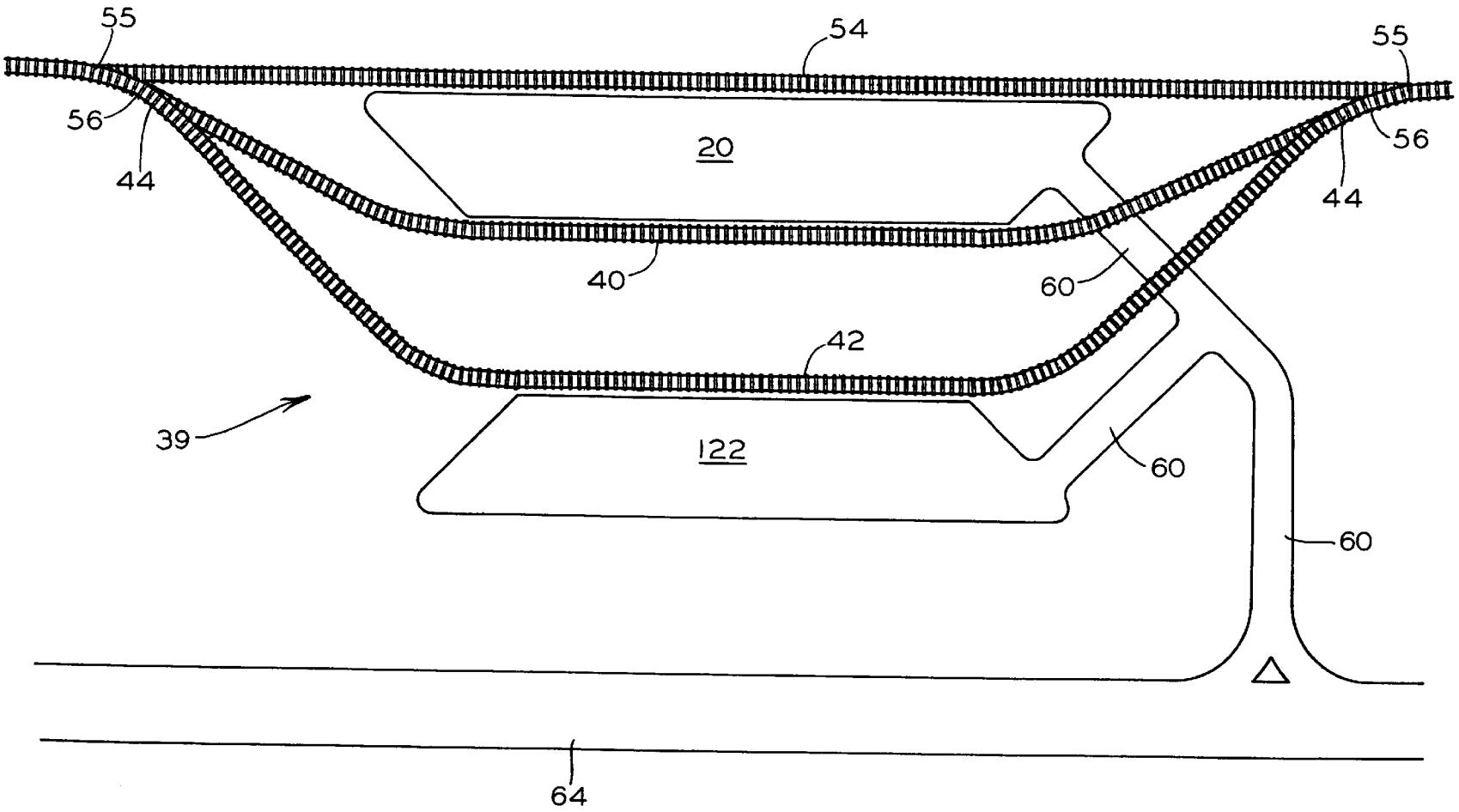
FIG. 6 shows highway vehicle connections for a terminal which has two docks.

FIG. 6 shows a plan view of terminal 39 with track connections 56 to an external track system 54, and roadway connections 60 to an external highway system 64. First track portion 40 and spur 42 are joined to connection tracks 56 at switches 44. Connection tracks 56 are connected to external track 54 and switches 55.

Figure 7A:
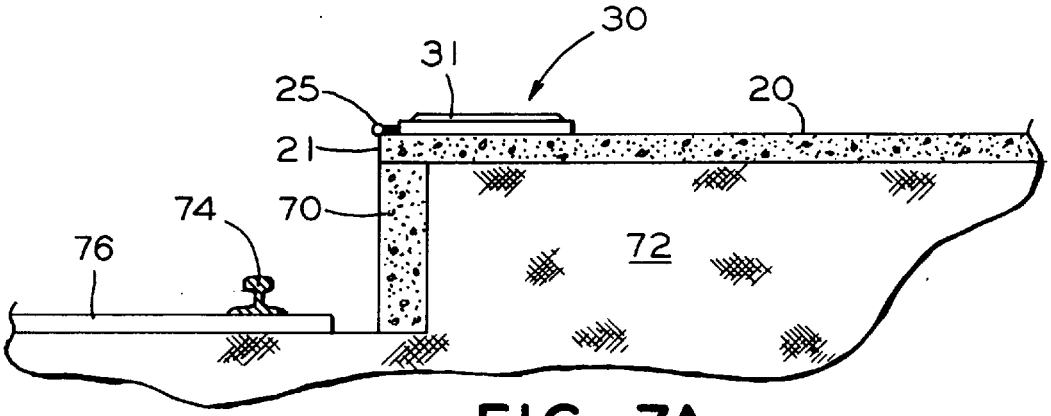
FIG. 7A shows an edge portion of a dock and a hinged dock plate.

FIGS. 7A through 7D show various options for docks and ramps for enabling highway vehicles to be driven onto or pulled onto railway vehicles 24. FIG. 7A shows a vertical section of dock 20 at a place on dock 20 which includes a dock plate 30. Dock plate 30 is shown in retracted position in which it is laid back on dock 20. Ribs 31 are indicated on the lower surface of dock plates 30. A hinge 25 is shown which attaches dock plate 30 to dock edge 21. The dock has retaining wall 70 which keeps earth 72 in place. A rail 74 is shown on tie 76. Rail 74 represents be one rail of either track segment 14 or 40.

Figure 7B:
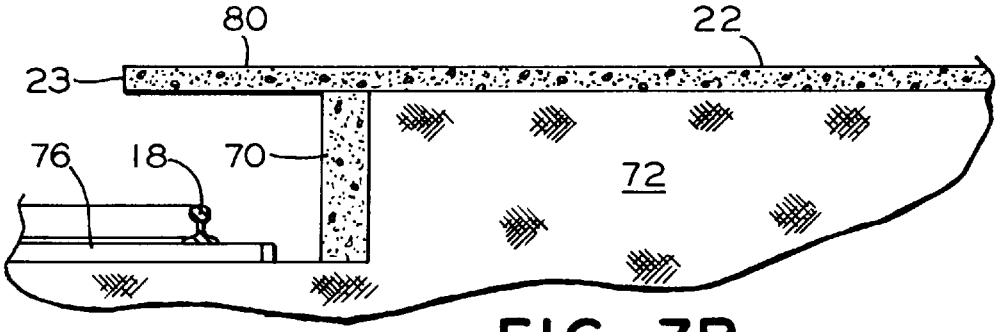
FIG. 7B shows a dock having an undercut which provides space for a truck of the railway vehicle and an end portion of a spur.

FIG. 7B shows a vertical section of dock 22 where it is undercut to provide an overhanging portion 80. Rail 18 is one rail of one of the spurs 18. Spur 18 approaches dock 22 obliquely as shown in FIG. 1, and protrudes underneath overhanging portion 80 of dock 22, so that a truck (not shown in this figure) can be positioned with its pivot 28 approximately underneath edge 23 of dock 22. In this manner, dock plates 30 are not needed adjacent dock 22.

Figure 7C:
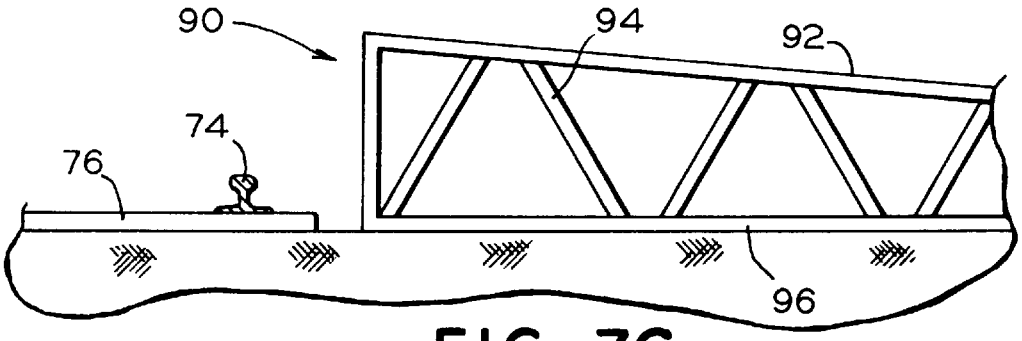
FIG. 7C shows a portable ramp.

FIG. 7C shows a portable ramp 90 positioned near rail 74 and tie 76. Ramp 90 has surface for support of highway vehicles 92 supported on structural members 94 on base 96.

Figure 7D:
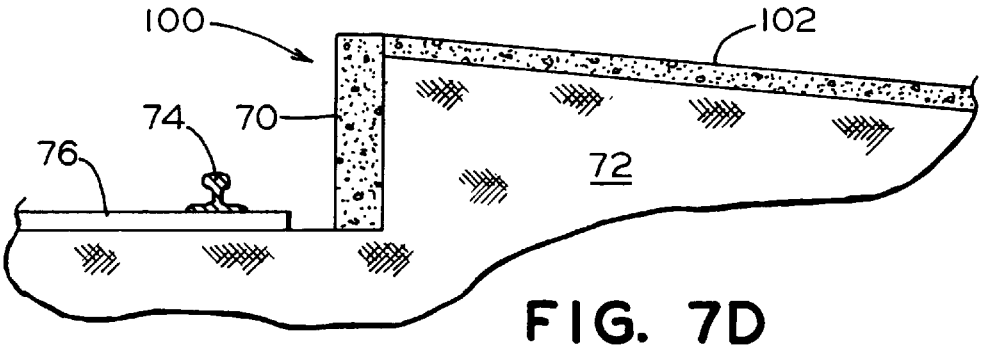
FIG. 7D shows an earthen ramp.

FIG. 7D shows an earthen ramp. It has retaining wall 70 to keep earth 72 in place. Earth 72 supports surface for support of highway vehicles, 102.

Figure 8:
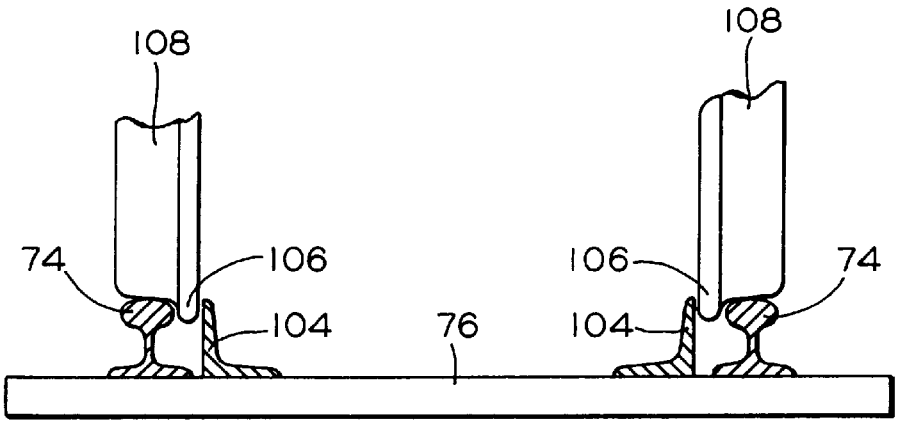
FIG. 8 shows guide rails which may be used to prevent derailment due to side loads on the railway vehicles in the zig-zag configuration.

FIG. 8 shows a vertical cross section of a portion of track such as first track portions 14 or 40, or spurs 18 or 42. Guide rails 104 are introduced to prevent derailment of trucks 46 or 48 due to side loadings caused by the zig-zag configuration. Guide rails 104 are placed as shown, inboard of rails 74, spaced to allow clearance for flanges 106 of wheels 108 of trucks 46 or 48. Guide rails 104 may be slightly higher than rails 74 to provide more positive contact with flanges 106 of wheels 108 when required.

Figure 9A:
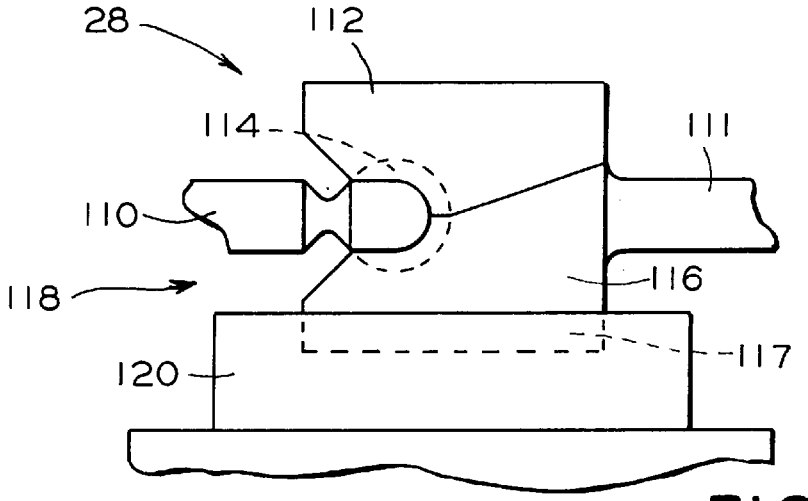
FIGS. 9A and 9B show an articulated coupler and load bearing pivot.
Figure 9B:
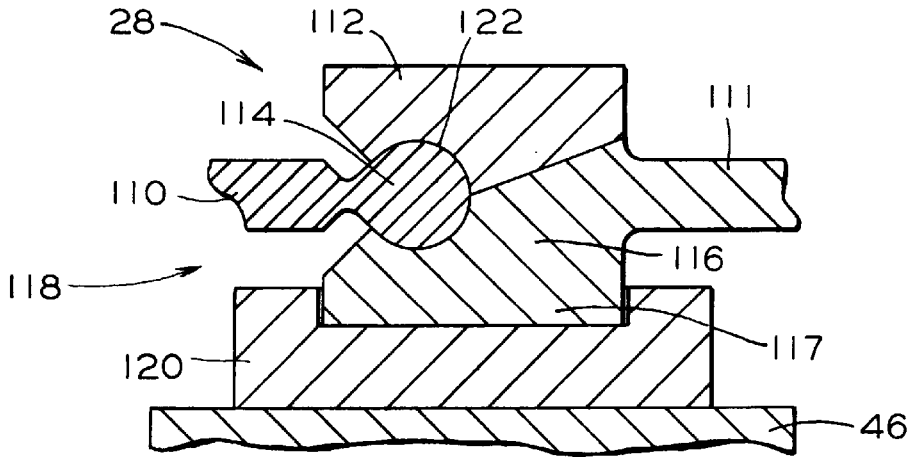

FIGS. 9A and 9B show an articulated coupler 28 which joins an adjacent pair of railway vehicles 24 (not shown in this figure). FIG. 9A is a side view of the coupler and FIG. 9B is a vertical median cross section. A longitudinal structural member 110 is connected to a portion of a railway vehicle 24 (not shown in this figure). It may be connected to a center sill of vehicle 24. Its end terminates in or is connected to a ball 114 which is partially enclosed in a socket formed by lower socket portion 116 and upper socket portion 112. Socket portions 112 and 116 are connected. Lower socket portion 116 is connected to or integral with longitudinal structural member 111 which is connected to an adjacent railway vehicle 24. Lower portion 117 of lower socket portion 116 is formed cylindrically to be rotatably contained within bowl 120, which is attached to truck 46. Bowl 120 and lower portion 117 cooperate to act as a rotary load bearing connection 118.

Another embodiment of the present invention is also proposed which eliminates all of the dock plates 30, and requires only small dock plates at the ends 57 of the consist. This configuration would employ the same vehicles 24 as the preceding embodiments. This configuration would be similar to the configuration shown in FIG. 3, except that dock 20 would have an overhang, and the edge of dock 20 would lie approximately over the centerline of first track portion 40.

A consist of vehicles 24 could move through this embodiment, provided first track portion 40 and spur 42 run precisely parallel in the space between the two docks, at a relative distance appropriate for the zig-zag configuration. No other railway vehicle would be able to pass through this configuration. A consist of vehicles 24 could be moved into this terminal and placed in the required zig-zag configuration by conventional railway vehicles at either end which do not enter the space between the two docks.

Figure 10A:
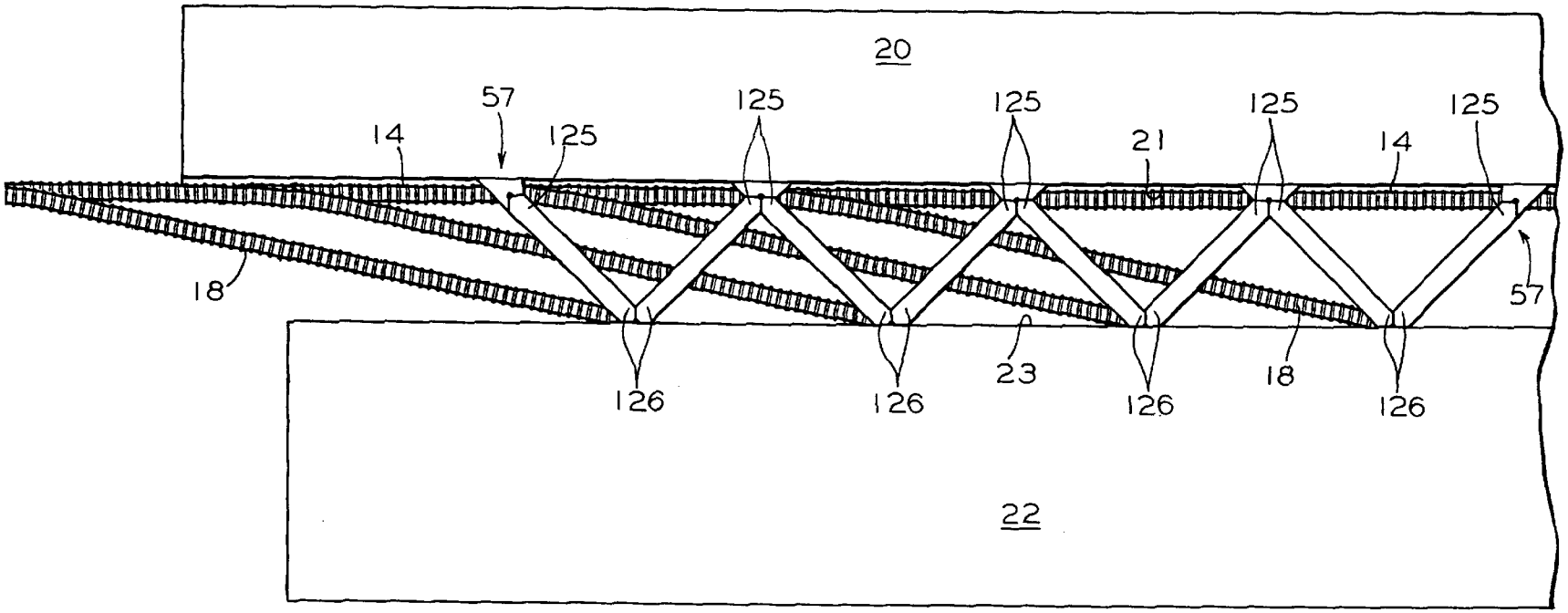
FIG. 10A shows a consist in a terminal having a multi spur configuration, and labels the first and second sets of vehicle ends.
Figure 10B:
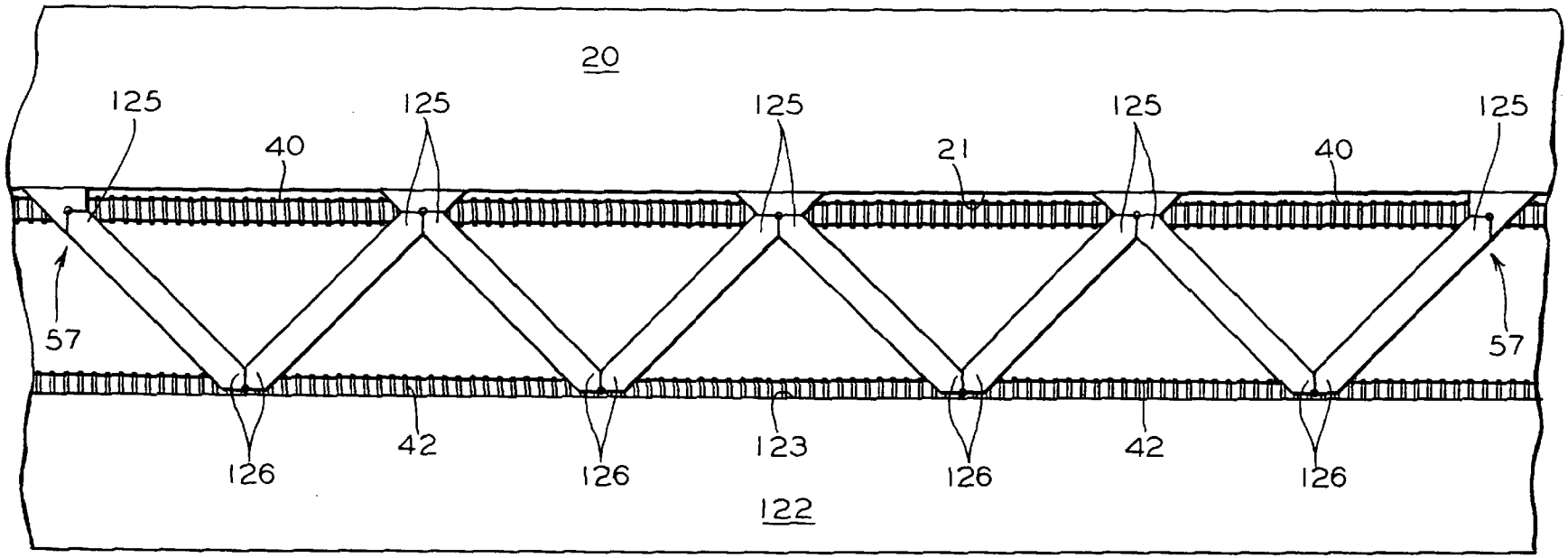
FIG. 10B shows a consist in a terminal having a single spur configuration, and labels the first and second sets of vehicle ends.

FIGS. 10A and 10B illustrate terminology used in the claims. FIG. 10A is for the multi spur configuration and FIG. 10B is for the single spur configuration.

FIG. 10A shows the first set of car ends 125 which remain on the first track portion 14, and it shows the second set of car ends 126 which are diverted onto spurs 18.

FIG. 10B shows the first set of car ends 125 which remain on the first track portion 40, and it shows the second set of car ends 126 which are diverted onto spur 42.

The ends of the consist are denoted 57. Details regarding the ends of the consist are shown in FIG. 5. FIG. 5 shows truck 48 which supports the end of the consist through rotary load bearing connection 29.

Now, discussing the invention more broadly, there is disclosed a system for transporting highway vehicles on railway vehicles which includes a consist of railway vehicles 24 configured so that adjacent pairs of railway vehicles 58 and 59 can be positioned relative to one another at a relative angle of at least 50 degrees, each of the railway vehicles 24 having a deck for supporting one or more highway vehicles. The deck is not necessarily a planar surface. For example, it may have a raised portion along the centerline of the railway vehicle which is straddled by wheels of the highway vehicle. Alternately, the deck may only provide support surfaces where necessary to support the wheels of a highway vehicle, with the center portion of the deck missing. The deck may have raised edges to help a driver of a highway vehicle to position it accurately on the railway vehicle.

The system also includes a railroad terminal 10 or 39 having a terminal track system which has a first track portion 14 or 40 connected to a railroad track system outside of the terminal 34 or 54, so that the consist of railway vehicles 24 may be moved by a motive means such as a locomotive from the track system outside of the terminal onto the first track portion 14 or 40. The terminal track system has at least one switch 16 or 44 having a common track connection 131 or 136, a first selectable track connection 132 or 137 and a second selectable track connection 133 or 138. The first track portion 14 or 40 is connected to the common track connection of the switch or switches 16 or 44 and to the first selectable track connection of the switch(es). The terminal track system also has one or more track spurs 18 or 42 connected to the second selectable track connection(s) of the switch(es) so that as the consist of railway vehicles 24 is moved along the first track portion 14 or 40, a first set of trucks supporting a first set of ends 125 of the railway vehicles of the consist may be kept on the first track portion 14 or 40, while a second set of trucks supporting a second set of ends 126 of the railway vehicles of the consist is directed by the switch(es) 16 or 44 onto the track spur(s) 18 or 42 connected to the second selectable track connection(s) of the switch(es). In this manner, the consist of railway vehicles is placed in a zig-zag configuration. This configuration is such that each railway vehicle has a truck supporting one end of the vehicle on the first track portion 14 or 40, while a truck supporting the other end of the vehicle is supported on a track spur 18 or 42. The track system has dimensional parameters relative to the length of the railroad vehicles such that for each truck, a unit vector parallel to the direction of travel of the truck along the track supporting it has a vector component of at least 0.25 in a direction parallel to a longitudinal axis of at least one railway vehicle 24 having an end supported on the truck, so that forces for moving the railway vehicles into and out of the zig-zag configuration may be communicated along the consist of railway vehicles 24 by either tension or compression communicated longitudinally along the railway vehicles.

Figure 11A:
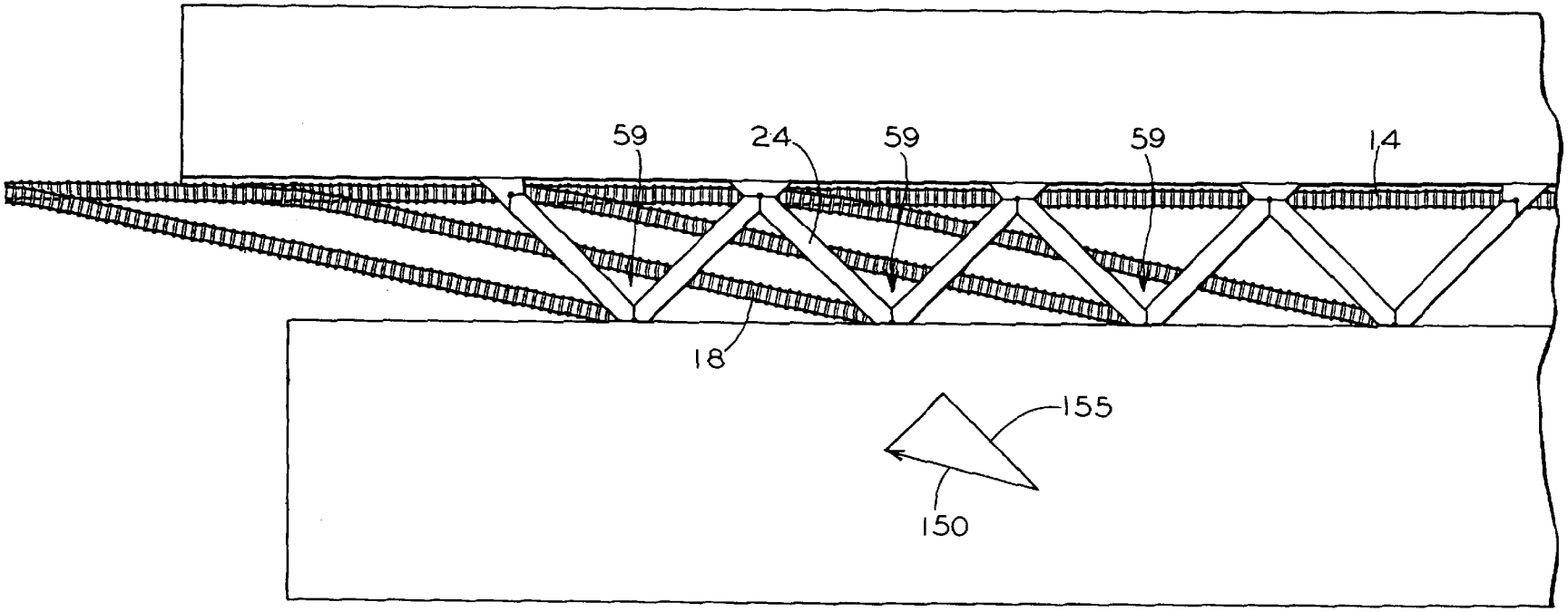
FIG. 11A illustrates vector relationships between the railway vehicles and the track spurs for a multi spur configuration.

These vector relationships are illustrated in FIG. 11A for the multi spur case. Vector 150 is parallel to spur 18 which is the direction of travel of the truck (not shown in this figure) which supports ends 59 of railway vehicles 24 on spur 18. The component of vector 150 parallel to the longitudinal axis of railway vehicle 24 is denoted 155. The length of vector 155 is crucial to the invention so that the railway vehicles 24 can be moved by tension or compression communicated longitudinally along the railway vehicles 24. For the configuration illustrated in FIG. 11A, the length of vector 155 is about 0.9.

Figure 11B:
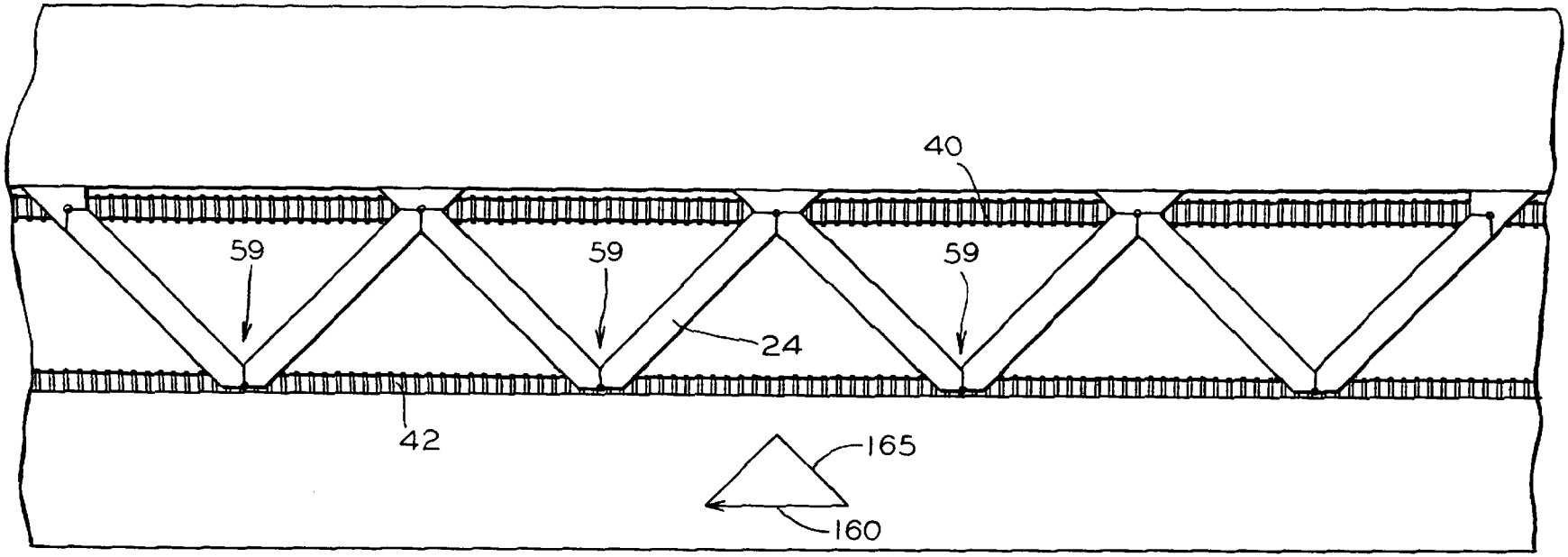
FIG. 11B illustrates vector relationships between the railway vehicles and the track spurs for a single spur configuration.

FIG. 11B illustrates the vector relationships for the single spur case. Vector 160 is parallel to the direction of travel of the truck (not shown in this figure) that supports ends 59 of railway vehicles 24 on spur 42. The component of vector 160 parallel to the longitudinal axis of railway vehicle 24 is denoted 165. The length of vector 165 is crucial to the invention so that the railway vehicles 24 can be moved by tension or compression communicated longitudinally along the railway vehicles 24. For the configuration illustrated in FIG. 11B, the length of vector 165 is about 0.7.

The terminal has at least one surface for support of highway vehicles 20, 22 or 122, at least a portion of the surface having an elevation about equal to the elevation of at least one end 26 of at least one of the railway vehicles 24 and adjacent the railway vehicle so that highway vehicles may be either driven onto or pulled onto the railway vehicle from the surface for support of highway vehicles 20, 22 or 122, and also driven off of or pulled off of the railway vehicle onto the surface for support of highway vehicles. The surface for support of highway vehicles has a roadway or other driveable path 60 to a roadway system outside of the terminal 64.

Adjacent pairs of railway vehicles 24 may be joined to each other by an articulated coupler 28 which is capable of accommodating the relative angle of at least about 50 degrees between the pair of railway vehicles 24. One or more of the vehicles 24 may be supported on one of trucks 46 or 48 by a rotary load bearing connection 118.

The surface for support of highway vehicles may be a dock, 20, 22 or 122 which has an edge 21, 23 or 123 adjacent a plurality of the ends 26 of railway vehicles 24.

The system may include a dock plate 30 or 32 to span a gap between dock 20,22, or 122 and one of the decks of railway vehicles 24.

The surface for support of railway vehicles may be a moveable ramp 90 or an earthen ramp 100 which leads from an elevation of nearby terrain to about the elevation of the decks of railway vehicles 24.

The decks on the railway vehicles may have bevelled ends which highway vehicles may use to drive onto and off of the railway vehicles 24. The terminal track system 12 may be so configured in relation to the length of the railway vehicles 24 that when they are placed in the zig-zag configuration, adjacent vehicles meet at an angle of about 90 degrees. The ends of the railway vehicles may be bevelled at an angle of about 45 degrees to provide a support surface for highway vehicles to drive onto and off of the railway vehicles. The surface for support of highway vehicles 20, 22 or 122 may have an edge 21, 23 or 123 which lies adjacent a pair of bevelled ends 26 of vehicles 24 and oriented at an angle of about 45 degrees relative to vehicles 24. The surface for support of highway vehicles 20, 22 or 122 may be undercut to provide space for portions of the railway vehicles 24 and the trucks 46 or 48.

One or more of the end bogies 48 may have a rotary load bearing connection 118 having a portion attached to or contiguous with a longitudinal tension-compression member 50 connected to an industry standard coupler 52.

The system may also have one or more guide rails 104 located between load bearing rails 74 on either the first track portion 14 or 40 and/or on a spur 18 or 42 so that lateral forces on railroad vehicles 24 may be borne by contact between an outer surface of flange 106 of wheel 108. Guide rails 104 may have an elevation higher than load bearing rails 74. A pair of guide rails may be used to accommodate lateral forces in either direction.

The terminal may have a single spur 42 and two switches 44 connected to opposite ends of spur 42 so that a consist of railway vehicles 24 may be moved in a single direction through terminal 39. The second set of car ends 126 are directed onto single spur 42, to place the railway vehicles in a zig-zag configuration, and subsequently, the switch 44 at the other end of spur 42 is used to bring the second set of car ends 126 back onto first track segment 40 without reversing the direction of travel of the consist.

The terminal may have a single switch 44 which has a second selectable track connection 138 for directing the second set of car ends 126 onto a single spur 42.

Spur 42 may diverge from first track portion 40 and then turn back to run parallel to the first track portion 40. The surface for support of highway vehicles may include a first dock 20 having an edge adjacent first track portion 40 plus a second dock 122 having an edge either above or adjacent to spur 42. Each end 26 of each of the railway vehicles 24 may be supported on an individual truck 46. Alternatively, both adjacent ends of adjacent railway vehicles 24 may be supported on a common truck 46.

In an additional aspect, there is disclosed a system for transporting highway vehicles on railway vehicles which includes a consist of railway vehicles 24 configured so that adjacent pairs of railway vehicles 58 and 59 can be positioned relative to one another at a relative angle of at least about 50 degrees, each of the railway vehicles 24 having a deck for supporting one or more highway vehicles. The deck is not necessarily a planar surface. For example, it may have a raised portion along the centerline of the railway vehicle which is straddled by wheels of the highway vehicle. Alternately, the deck may only provide support surfaces where necessary to support the wheels of a highway vehicle, with the center portion of the deck missing. The deck may have raised edges to help a driver of a highway vehicle to position it accurately on the railway vehicle.

The system also includes a railroad terminal 10 having a terminal track system 12 which has a first track portion 14 connected to a railroad track system outside of the terminal 34 or 54, so that the consist of railway vehicles 24 may be moved by a motive means such as a locomotive from the track system outside of the terminal onto the first track portion. The terminal track system 12 has a plurality of switches 16 each having a common track connection 131, a first selectable track connection 132 and a second selectable track connection 133. The first track portion 14 is connected to the common track connections of switches 16 and to the first selectable track connections of switches 16. The terminal track system 12 also has a plurality of track spurs 18 connected to the second selectable track connections of switches 16 so that as the consist of railway vehicles 24 is moved along the first track portion 14, a first set of trucks supporting a first set of adjacent ends 125 of the vehicles of the consist may be kept on the first track portion, while a second set of trucks supporting a second set of ends 126 of the vehicles of the consist is directed by switches 16 onto the track spurs 18 connected to the second selectable track connections of the switches. In this manner, the consist of railway vehicles is placed in a zig-zag configuration. This configuration is such that each railway vehicle has a truck supporting one end of the vehicle on the first track portion 14, while a truck supporting the other end of the vehicle is supported on a track spur 18. The track system has dimensional parameters relative to the length of the railroad vehicles such that for each truck, a unit vector parallel to the direction of travel of the truck along the track supporting it has a vector component of at least 0.25 in a direction parallel to a longitudinal axis of at least one railway vehicle 24 having an end supported on the truck, so that forces for moving the railway vehicles move into and out of the zig-zag configuration may be communicated along the consist of railway vehicles 24 by either tension or compression communicated longitudinally along the railway vehicles.

The terminal has at least one surface for support of highway vehicles 20, or 22, at least a portion of the surface having an elevation about equal to the elevation of at least one end 26 of at least one of the railway vehicles 24 and adjacent the railway vehicle so that highway vehicles may be either driven onto or pulled onto the railway vehicle from the surface for support of highway vehicles 20 or 22, and also driven off of or pulled off of the railway vehicle onto the surface for support of highway vehicles. The surface for support of highway vehicles has a roadway or other driveable path 60 to a roadway system outside of the terminal 64.

A single truck 46 may be used to support both of the adjacent ends 58 or 59 of the railway vehicles 24. The number of switches 16 may be one half of the number of railway vehicles 24 in the consist.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

We claim:

1. A system for transporting highway vehicles on railway vehicles, said system comprising:

a consist of railway vehicles configured so that adjacent pairs of said railway vehicles can be positioned relative to one another at a relative angle of at least about 50 degrees, each of said railway vehicles having a deck for supporting at least one highway vehicle;

a railroad terminal having a terminal track system having a first track portion connected to a railroad track system outside of said terminal, so that said consist of railway vehicles may be moved by a motive means from said track system outside of said terminal onto said first track portion, said terminal track system having at least one switch having a common track connection, and a first selectable track connection and a second selectable track connection, said first track portion connected to said common track connection and to said first selectable track connection, said terminal track system also having at least one track spur connected to said second selectable track connection of said at least one switch so that as said consist of railway vehicles is moved along said first track portion, a first set of trucks supporting a first set of ends of said railway vehicles may be retained on said first track portion while a second set of trucks supporting a second set of ends of said railway vehicles may be directed by said at least one switch onto said at least one track spur connected to said second selectable track connection of said at least one switch, so that said consist of railway vehicles is placed in a zig-zag configuration, such that for each railway vehicle, a truck supporting a first end of said vehicle is supported on said first track portion, and a truck supporting a second end of said vehicle is supported on said at least one track spur, said track system having dimensional parameters relative to a length of said at least one railway vehicle so that for each truck, a unit vector parallel to a direction of travel of said truck has a vector component of at least about 0.25 in a direction parallel to a longitudinal axis of at least one railway vehicle having an end supported on said truck when said railway vehicle is in position for loading and unloading, so that forces for moving said railway vehicles into and out of said zig-zag configuration may be communicated along said consist of railway vehicles by at least one of tension and compression communicated longitudinally along said railway vehicles; and said terminal having at least one surface for support of highway vehicles, said surface for support of highway vehicles having at least a portion thereof at an elevation about equal to an elevation of at least one end of at least one of said railway vehicles and adjacent said at least one end of said at least one railway vehicle so that such highway vehicles may be at least one of driven onto and pulled onto said at least one railway vehicle from said surface for support of highway vehicles, and also at least one of driven off of and pulled off of said at least one railway vehicle onto said surface for support of highway vehicles, said surface for support of highway vehicles having highway vehicle connection to a roadway system outside of said terminal.

2. A system according to claim 1 wherein at least one of said adjacent pairs of said railway vehicles in said consist are joined to each other by an articulated coupler, said articulated coupler capable of accommodating said relative angle of at least about 50 degrees between said pair of railway vehicles, said articulated coupler supported on one of said trucks.

3. A system according to claim 1 wherein at least one of said adjacent pairs of said railway vehicles in said consist have adjacent ends supported on one of said trucks by rotary load bearing connections, at least one of said rotary load bearing connections accommodating an angle of at least about 25 degrees between a one of said vehicles supported on said load bearing connection and said truck.

4. A system according to claim 1 wherein said at least one surface for support of highway vehicles includes a dock having an edge adjacent a plurality of said adjacent ends of said railway vehicles.

5. A system according to claim 4 further including a dock plate spanning a gap between said dock and at least one of said decks of said railway vehicles.

6. A system according to claim 1 wherein said at least one surface for support of highway vehicles is a ramp leading from an elevation of nearby terrain to an elevation about equal to an elevation of at least one of said decks of said railway vehicles.

7. A system according to claim 1 wherein said decks on said railway vehicles have bevelled ends.

8. A system according to claim 1 wherein said terminal track system is so configured in relation to said length of said railway vehicles that when said consist is placed in said zig-zag configuration, adjacent vehicles meet at a relative angle of at least about 50 degrees and no more than about 150 degrees.

9. A system according to claim 8 wherein said terminal track system is so configured in relation to said length of said railway vehicles that when said consist is placed in said zig-zag configuration, adjacent vehicles meet at a relative angle of about 90 degrees.

10. A system according to claim 9 wherein said decks of said railway vehicles have ends bevelled at about 45 degrees, so that a highway vehicle on one railway vehicle may be partially supported by an end portion of said deck of said railway vehicle carrying said highway vehicle, and is also partially supported by an end portion of a deck on an adjacent railway vehicle when said highway vehicle is moved onto or off of said railway vehicle.

11. A system according to claim 9 wherein said surface for support of highway vehicles has an edge adjacent to two opposite beveled ends of said pair of adjacent railway vehicles, said edge oriented at an angle of about 45 degrees relative to each of said adjacent railway vehicles.

12. A system according to claim 1 wherein said surface for support of highway vehicles is undercut to provide space for portions of at least one of said railway vehicles and said trucks.

13. A system according to claim 1 wherein at least one end truck of said consist has a rotary load bearing connection for supporting an end of a corresponding end vehicle of said consist of railway vehicles, said rotary load bearing connection being at least one of attached to and contiguous with a longitudinal tension-compression member connected to a conventional industry-standard coupler so that said consist may be coupled to a like consist, or to other railway vehicles having industry standard couplers.

14. A system according to claim 1 further comprising at least one guide rail disposed between load bearing rails of at least one of said first track portion and said at least one spur adjacent one of said load bearing rails so that lateral forces on said railway vehicles may be borne by contact between an outer surface of at least one flanged wheel and said at least one guide rail whereby derailment of said railway vehicles may be prevented.

15. A system according to claim 14 wherein said at least one guide rail has an elevation higher than said load bearing rails to improve contact between said outer surface of said at least one flanged wheel and said guide rail.

16. A system according to claim 14 wherein said at least one guide rail is a pair of guide rails, each disposed adjacent one of said load bearing rails to bear lateral loads in either of a pair of opposite directions.

17. A system according to claim 1 wherein said at least one spur is one spur and said at least one switch is a pair of switches, a first one of said pair of switches connecting a first end of said spur to said first track portion and a second one of said pair of switches connecting a second end of said spur to said first track portion.

18. A system according to claim 1 wherein said at least one switch is one switch and said at least one spur is one spur.

19. A system according to claim 18 wherein said spur diverges away from said first track portion and then turns back to run parallel to said first track portion.

20. A system according to claim 18 wherein said at least one surface for support of highway vehicles includes a first dock having an edge adjacent to said first track portion, plus a second dock having an edge at least one of above and adjacent to said spur.

21. A system according to claim 18 wherein each end of each of said railway vehicles in said consist is supported on an individual truck.

22. A system according to claim 18 wherein adjacent ends of adjacent railway vehicles in said consist are supported on a common truck.

23. A system for transporting highway vehicles on railway vehicles, said system comprising:

a consist of railway vehicles configured so that adjacent pairs of said railway vehicles can be positioned relative to one another at a relative angle of at least about 50 degrees, each of said railway vehicles having a deck for supporting at least one highway vehicle;

a railroad terminal having a terminal track system having a first track portion connected to a railroad track system outside of said terminal, so that said consist of railway vehicles may be moved by a motive means from said track system outside of said terminal onto said first track portion, said terminal track system having a plurality of switches, each switch having a common track connection, and a first selectable track connection and a second selectable track connection, said first track portion connected to said common track connection and to said first selectable track connection, said terminal track system also having a plurality of track spurs connected individually to individual ones of said second selectable track connections of said switches so that as said consist of railway vehicles is moved along said first track portion, a first set of trucks supporting a first set of ends of said railway vehicles of said consist may be retained on said first track portion, while each one of a second set of trucks supporting a second set of ends of said railway vehicles of said consist is directed by one of said plurality of switches onto one of said track spurs, so that said consist of railway vehicles is placed in a zig-zag configuration, such that for each railway vehicle, a truck supporting a first end of said vehicle is supported on said first track portion, and a truck supporting a second end of said vehicle is supported on one of said plurality of track spurs, said track system having dimensional parameters relative to a length of said at least one railway vehicle so that for each truck, a unit vector parallel to a direction of travel of said truck has a vector component of at least about 0.25 in a direction parallel to a longitudinal axis of at least one railway vehicle having an end supported on said truck when said railway vehicle is in position for loading and unloading, so that forces for moving said railway vehicles into and out of said zig-zag configuration may be communicated along said consist of railway vehicles by at least one of tension and compression communicated longitudinally along said railway vehicles; and said terminal having at least one surface for support of highway vehicles, said surface for support of highway vehicles having at least a portion thereof at an elevation about equal to an elevation of at least one end of at least one of said railway vehicles and adjacent said at least one end of said at least one railway vehicle so that such highway vehicles may be at least one of driven onto and pulled onto said at least one railway vehicle from said surface for support of highway vehicles, and also at least one of driven off of and pulled off of said at least one railway vehicle onto said surface for support of highway vehicles, said surface for support of highway vehicles having highway vehicle connection to a roadway system outside of said terminal.

24. A system according to claim 23 wherein for each pair of adjacent ends of said adjacent railway vehicles, a single truck supports both of said adjacent ends of said adjacent railway vehicles.

25. A system according to claim 23 wherein a number of said plurality of switches is equal to at least one half of a number of said railway vehicles in said consist.

26. A method of loading highway vehicles onto railway vehicles disposed in a consist of railway vehicles, said method comprising the steps of:

moving said consist of railway vehicles along a first track segment having at least one switch connected to at least one spur;

setting said switches so that as said consist is moved along said first track segment, a first set of trucks supporting a first set of ends of said railway vehicles is retained on said first track portion, while a second set of trucks supporting a second set of ends of said railway vehicles is directed by said at least one switch onto said at least one spur, so that said consist of railway vehicles is placed in a zig-zag configuration such that for each said railway vehicle, a truck supporting a first end of said vehicle is supported on said first track portion, and a truck supporting a second end of said vehicle is supported on said at least one track spur, said track system having dimensional parameters relative to a length of said at least one railway vehicle so that for each truck, a unit vector parallel to a direction of travel of said truck has a vector component of at least about 0.25 in a direction parallel to a longitudinal axis of at least one railway vehicle having an end supported on said truck when said railway vehicle is in position for loading and unloading, so that forces for moving said railway vehicles into and out of said zig-zag configuration may be communicated along said consist of railway vehicles by at least one of tension and compression communicated longitudinally along said railway vehicles;

providing at least one surface for support of highway vehicles having at least a portion thereof at about an elevation of a deck of at least one of said railway vehicles, said at least one surface for support of highway vehicles disposed adjacent at least one end of at least one of said railway vehicles;

moving said highway vehicles at least one of onto and off of said railway vehicles; and moving said consist of railway vehicles out of said zig-zag configuration so that said consist may be attached to a train and pulled over conventional railway lines.

* * * * *